US008926217B1

(12) United States Patent
Smith

(10) Patent No.: US 8,926,217 B1
(45) Date of Patent: Jan. 6, 2015

(54) BOAT CRADLE SYSTEM

(71) Applicant: Grady F. Smith, Greenville, NC (US)

(72) Inventor: Grady F. Smith, Greenville, NC (US)

( * ) Notice: Subject to any disclaimer, the term of this patent is extended or adjusted under 35 U.S.C. 154(b) by 157 days.

(21) Appl. No.: 13/683,163

(22) Filed: Nov. 21, 2012

(51) Int. Cl.
*B23Q 3/00* (2006.01)
*B63C 5/02* (2006.01)
*B63C 3/12* (2006.01)

(52) U.S. Cl.
CPC .... *B63C 5/02* (2013.01); *B63C 3/12* (2013.01)
USPC ..... 405/7; 405/3; 405/5; 248/176.1

(58) Field of Classification Search
CPC ..... B63C 5/00; B63C 3/02; B63C 3/12; B63C 5/02; B63B 27/36; B63B 23/30
USPC ..... 405/3, 5, 7; 248/176.1
See application file for complete search history.

(56) References Cited

U.S. PATENT DOCUMENTS

| | | | | | |
|---|---|---|---|---|---|
| 3,131,902 | A | * | 5/1964 | Zak, Jr. | 248/354.3 |
| 3,139,277 | A | * | 6/1964 | Mears | 269/296 |
| 3,379,314 | A | * | 4/1968 | Canning | 211/59.4 |
| 3,586,285 | A | * | 6/1971 | Modzelewski | 248/314 |
| 4,155,667 | A | * | 5/1979 | Ebsen | 405/7 |
| 4,392,627 | A | * | 7/1983 | van den Broek | 248/176.1 |
| 4,468,150 | A | * | 8/1984 | Price | 405/7 |
| 4,759,660 | A | * | 7/1988 | Corbett | 405/7 |
| 4,801,152 | A | * | 1/1989 | Elliott et al. | 280/47.34 |
| RE33,930 | E | * | 5/1992 | Ardent | 269/296 |
| 5,290,124 | A | * | 3/1994 | Pavlescak | 405/3 |
| 7,694,921 | B1 | * | 4/2010 | Williams | 248/127 |

* cited by examiner

*Primary Examiner* — Amy Sterling
(74) *Attorney, Agent, or Firm* — Coats and Bennett PLLC

(57) ABSTRACT

A boat cradle system for securely supporting boats, even in hurricane conditions, comprising one or more decks anchored to the ground or to an underlying structure. Moveably mounted on the deck or decks is a series of mobile boat supports that move back and forth between an inoperative position and an operative position.

14 Claims, 9 Drawing Sheets

BOAT CRADLE SYSTEM

FIELD OF THE INVENTION

The present invention relates to boat cradles.

BACKGROUND OF THE INVENTION

Cradling boats is expensive and time-consuming. Some marinas charge $2,500 and more to cradle a boat. This is because with present boat cradling systems, there is a huge amount of time and labor involved in cradling a boat.

Another problem faced by marinas and boat owners is that of providing a protection for a boat during hurricane seasons. In some locations, there are protected coves that provide some degree of protection. But in many geographical locations, such as in the Caribbean, there is not an abundance of protected coves, certainly not enough to satisfy the demand for hurricane protection. In some cases, marinas and boat owners utilize cradling system to support boats on land near waterways and seas. There are a number of problems with cradling systems employed for hurricane protection. Again, it is time-consuming and expensive to set up such cradling systems and position the boat for support by the cradling system. In addition, many cradling systems are not robustly designed and are ineffective for supporting a boat during a hurricane.

Therefore, there has been and continues to be a need for a boat cradling system that enables a boat to be loaded on the cradling system with a minimum amount of labor and in a minimum amount of time. Moreover, there is a need for a cradling system that is truly a hurricane cradling system that is strong and robust and will protect and support a boat in hurricane conditions.

SUMMARY OF THE INVENTION

The present invention relates to a boat cradling system that enables boats to be quickly and easily loaded onto the cradle system. In addition, the present invention relates to a cradling system that can be utilized in hurricane regions and which is designed structurally to support and protect a boat during a hurricane.

In one embodiment, the boat cradling system comprises a deck having a mobile boat support mounted thereon. The moveable boat support is moveable on the deck between an inoperative position and an operative position. In the operative position, the mobile boat support is positioned adjacent the boat and a support structure carried by the mobile boat support is extended into engagement with the boat.

In one particular embodiment of the present invention, the boat cradling system comprises a series of decks constructed of strong materials such as steel. Mounted on each deck is a moveable boat support that is moveable back and forth on the deck between the inoperative and operative positions. The mobile boat support includes a carriage and the carriage and deck are configured such that the carriage moves back and forth along a track and generally in a straight line.

The present invention further includes a method for loading a boat on the boat cradle system of the present invention. The method includes positioning the mobile boat supports in an inoperative position spaced outwardly from a boat receiving area. A boat is positioned between the mobile boat supports and the mobile boat supports are moved inwardly on the deck to positions adjacent the boat. Once positioned adjacent the boat, the mobile boat supports are anchored to the deck and a boat support structure is extended from the mobile boat supports to engage and support the boat.

Other objects and advantages of the present invention will become apparent and obvious from a study of the following description and the accompanying drawings which are merely illustrative of such invention.

DESCRIPTION OF EXEMPLARY EMBODIMENTS

Figure 1:
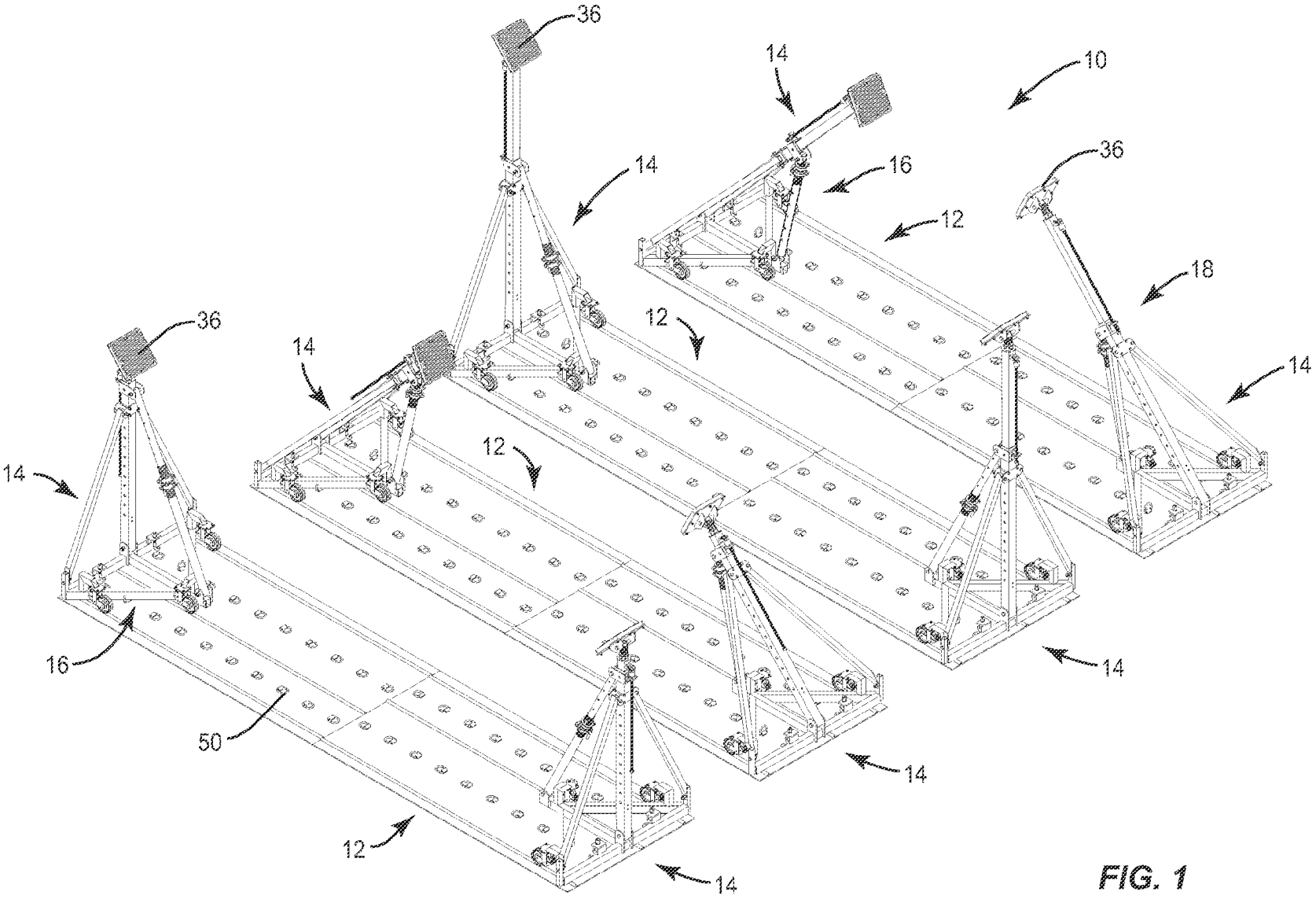
FIG. 1 is a perspective view of the boat cradle system of the present invention.

With further reference to the drawings, the boat cradle system of the present invention is shown therein and indicated generally by the numeral 10. As will be discussed below, the boat cradle system 10 is designed to enable a boat to be quickly and easily "cradled up" without requiring a large amount of manpower and time. Boat cradle system 10 includes a deck or main support structure 12. In the embodiment illustrated herein, the support structure includes a series of decks 12. Each deck 12 is constructed of a strong material that in one embodiment is metal. As seen in the drawings, each deck 12 is elongated and, when employed, the decks are disposed in spaced apart relationship over a ground or other underlying structure. See FIGS. 1 and 4. In use, the decks 12 are permanently anchored to the ground or to some underlying structure. In one embodiment, epoxied studs connect each deck 12 to bedrock. In other embodiments, the decks 12 are secured to the ground with large ground anchor screws.

The deck 12 may comprise a single member or piece or may be made up of multiple members or pieces. The deck 12 could be constructed of any suitable material that is hard and strong and which will support the mobile boat supports 14 that will be described in more detail subsequently herein.

Figure 2:
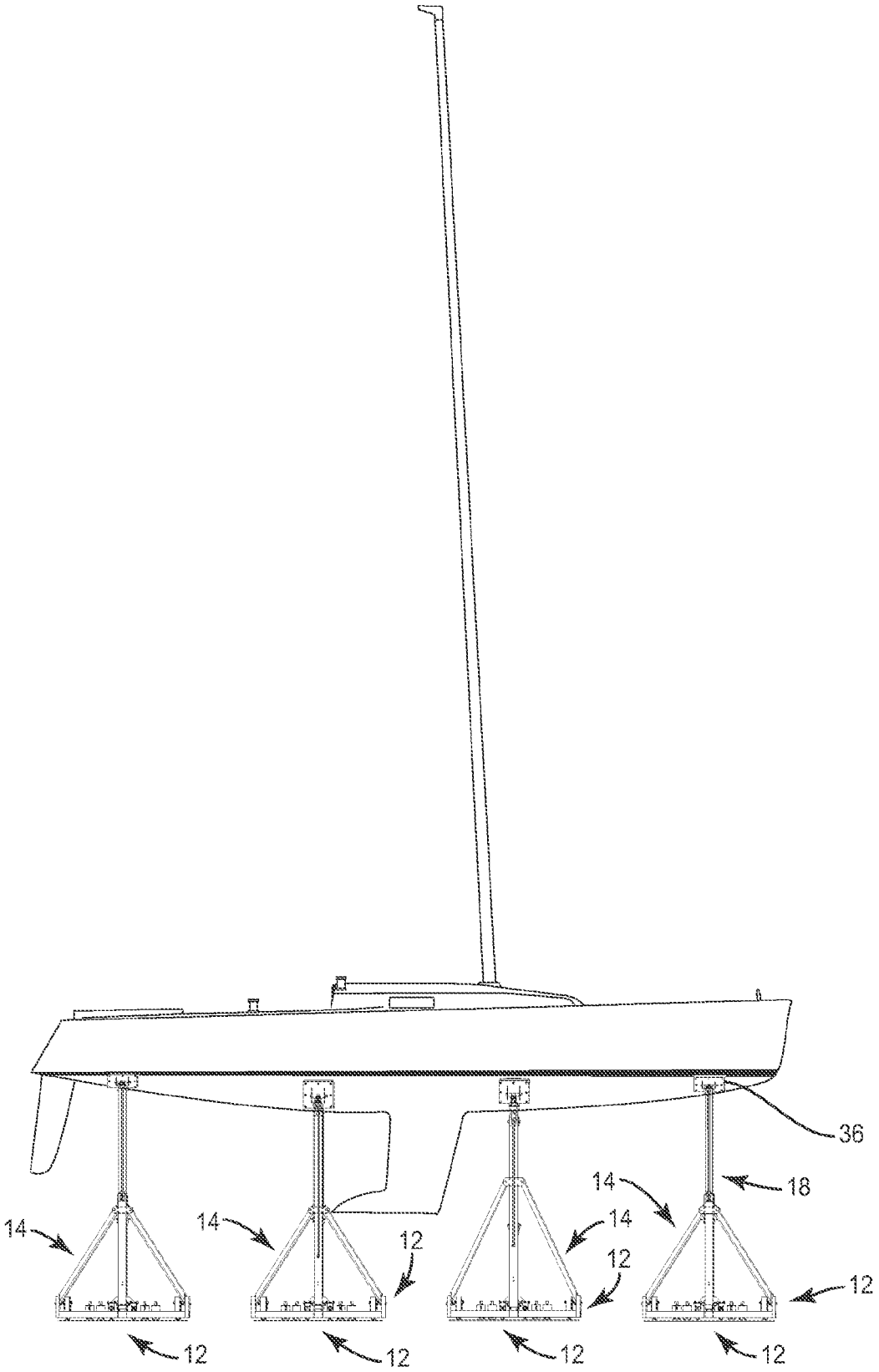
FIG. 2 is a side elevational view of the boat cradle system of the present invention shown supporting a boat.

Continuing to refer to the boat cradle system 10, the same is provided with a series of mobile boat supports with each mobile boat support being indicated generally by the numeral 14. As illustrated in the drawings, each mobile boat support is moveably mounted on a respective deck 12. When so mounted or positioned, the mobile boat support 14 can move back and forth, in generally a straight line, between an outer inoperative position and an inner operative position. As will be explained below, in the inner operative position, the mobile boat supports 14 are disposed adjacent a boat and anchored to the decks 12 and function to engage and support a boat in a cradle-like configuration. See FIG. 2.

Each mobile boat support 14 includes a carriage indicated generally by the numeral 16. Carriage 16 moves back and forth on a respective deck 12. A boat support structure is carried or supported on each carriage 16. In particular, mounted on each carriage 16 is an extendable support, indicated generally by the numeral 18, for engaging and supporting a boat. See FIG. 8.

Figure 5:
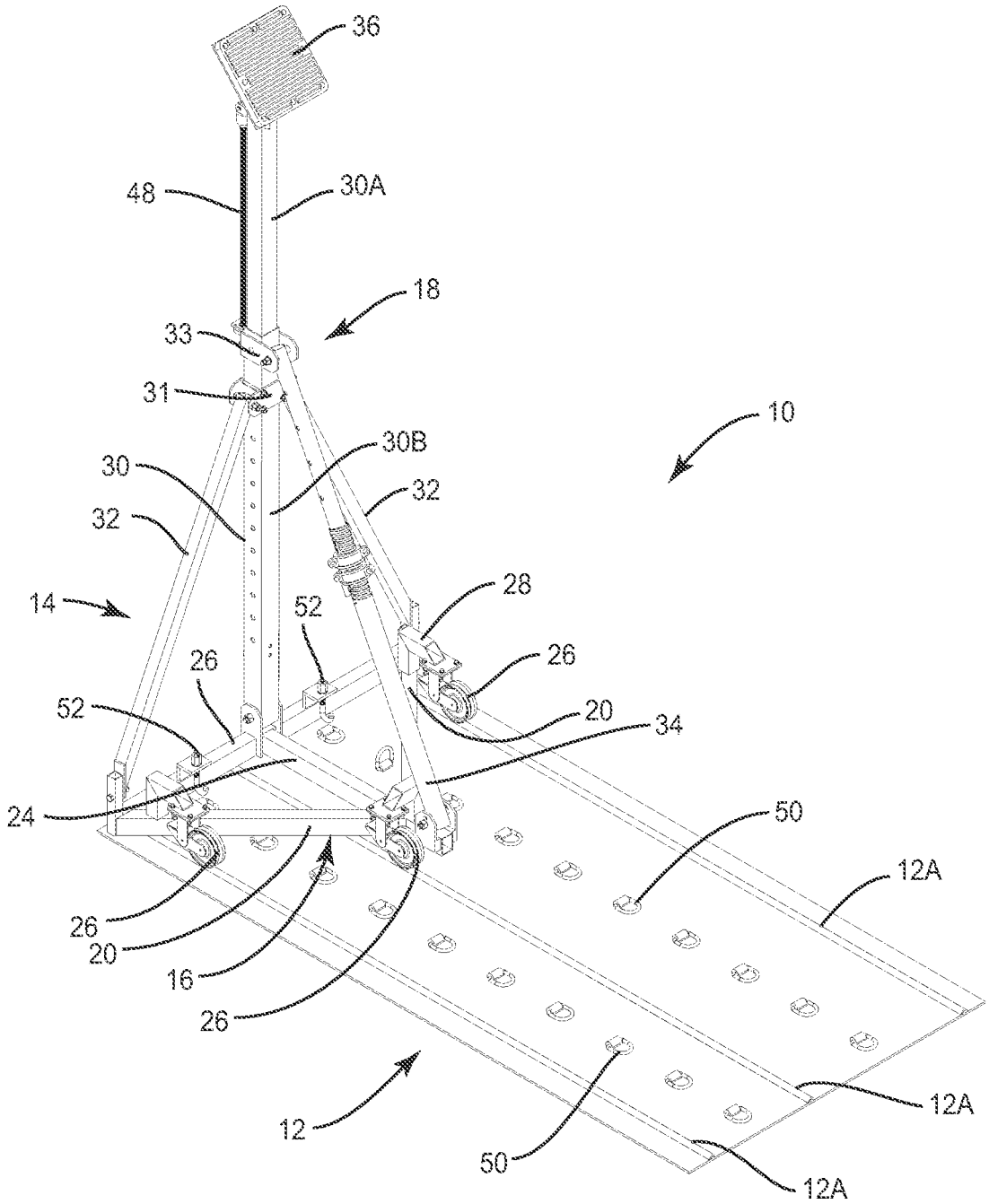
FIG. 5 is a perspective view of a deck and a mobile boat support mounted on the deck.
Figure 7:
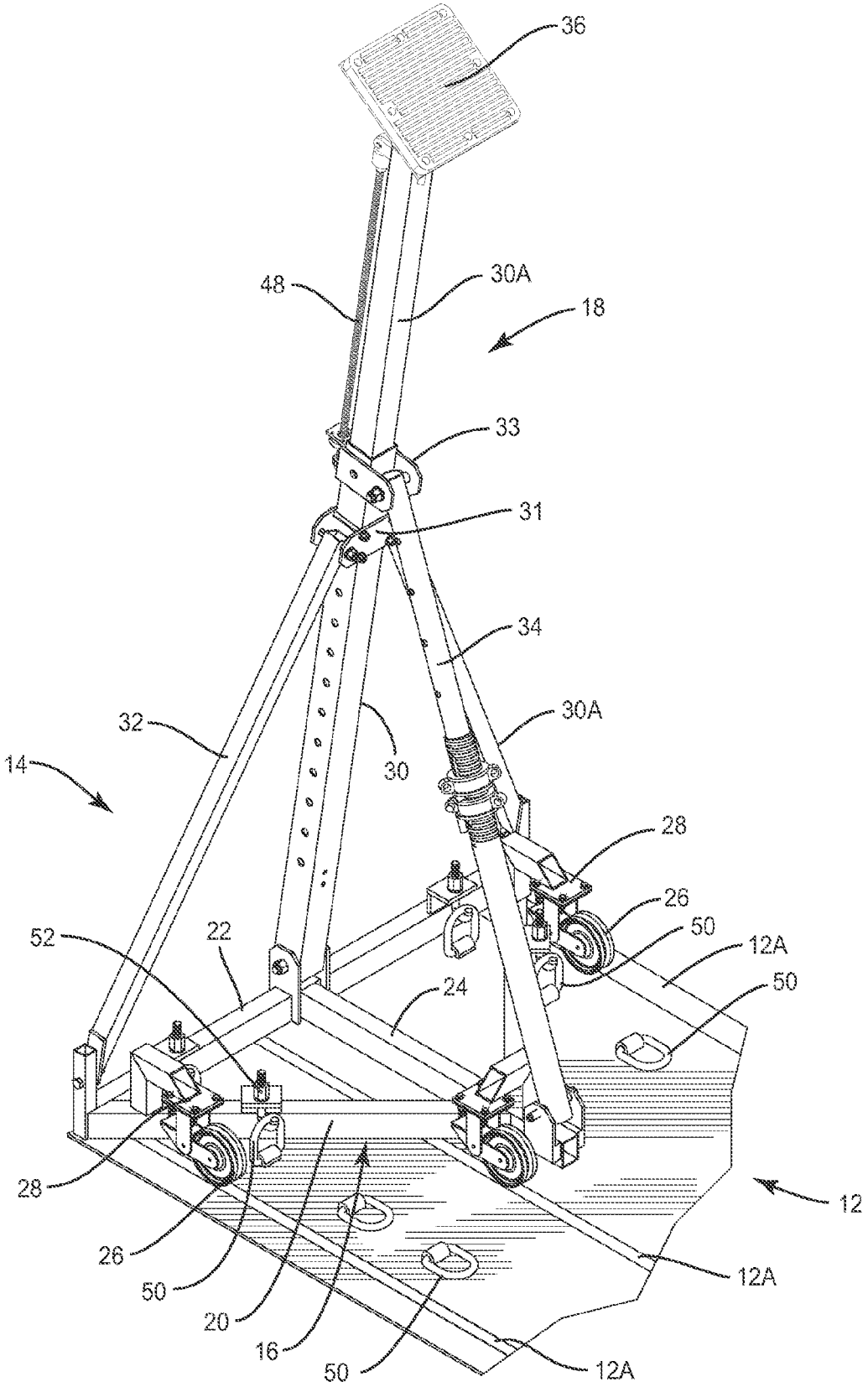
FIG. 7 is a fragmentary perspective view of a portion of the boat cradle system showing details of the mobile boat support.

Carriage 16, in the embodiment shown, includes a generally triangularly-shaped main frame. The main frame includes a pair of diagonal members 20 connected at rear ends by a back member 22. A central member 24 extends from an apex where the diagonal members 20 meet to a mid-point or mid-portion of the back member 22. See FIGS. 5 and 7. Carriage 16 in the embodiment illustrated includes a series of wheels. In the embodiment illustrated, carriage 16 includes three wheels 26, a front center wheel and a pair of rear outer wheels. Further, each wheel 26 is supported by a wheel support assembly 28 that projects from the triangular frame of the carriage 16. Wheel support assembly 28 spring loads a respective wheel 26. Wheel support assembly 28 and the wheels 26 secured thereto are designed to support the carriage 16 above the surface of the deck 12 such that the entire mobile boat support 14 can be easily moved back and forth along the underlying deck 12.

Each deck 12 and mobile boat support 14 is configured to enable the mobile boat support to track back and forth in a straight line. Various arrangements can be configured to provide for such. The feature being referred to is that of confining the mobile boat support 14 such that it moves back and forth along the upper surface of the deck 12 in a straight line and that the mobile boat support is easily moved by one person. One exemplary design provides a track structure on the upper surface of the deck 12 and a wheel design that results in the wheels of the carriage 16 being confined on the track structure. More particularly, in the case of the embodiment illustrated herein, the track structure includes a series of tracks 12A that rise above the upper surface of the deck 12. In the case of one example, the tracks 12A are generally inverted V-shaped. Accordingly, the wheels 26 of carriage 16 have a V-shaped groove formed therein. The V-shaped groove formed in the wheels 26 engage and ride on the inverted V-shaped tracks 12A of the deck 12.

Figure 8:
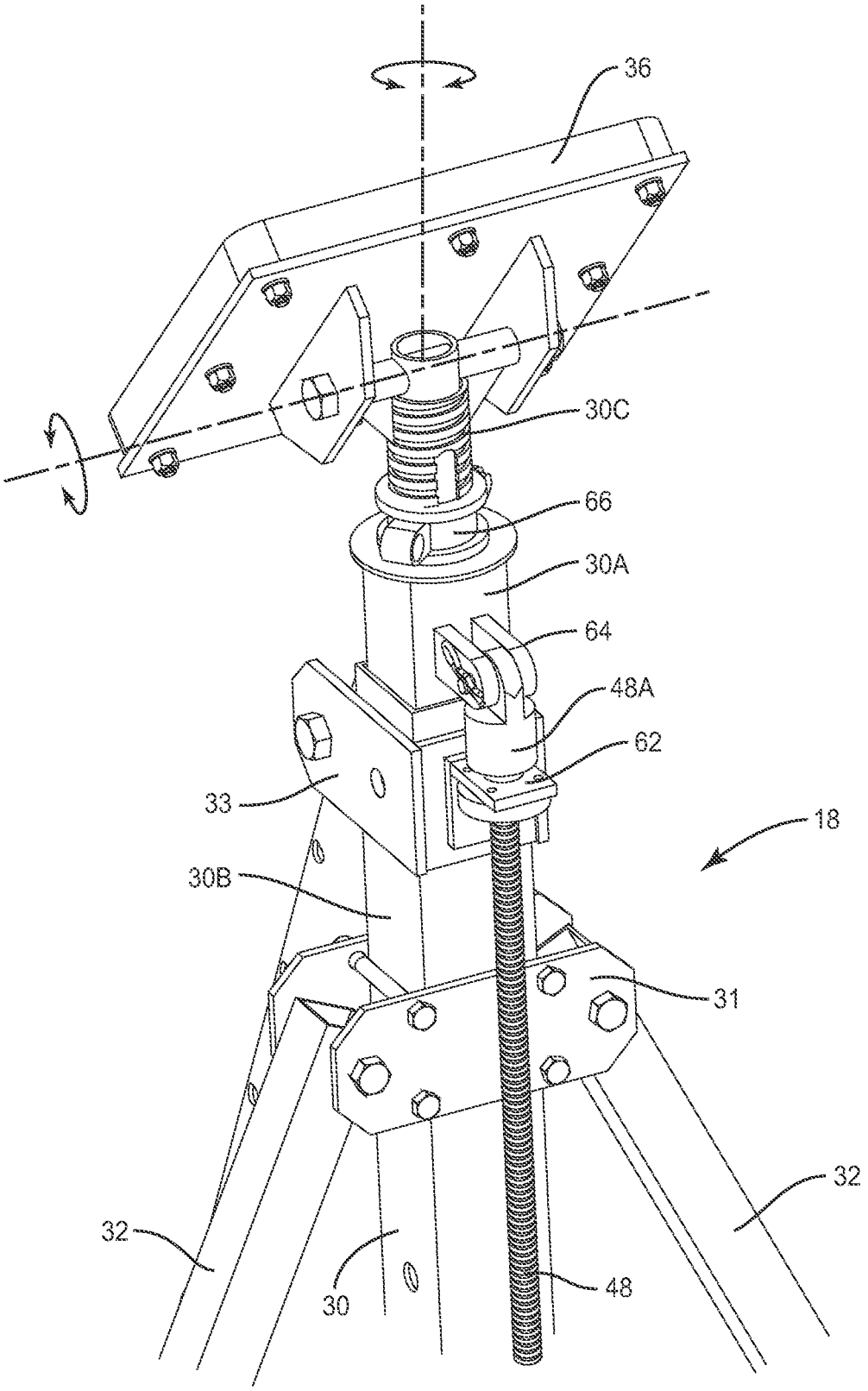
FIG. 8 is a fragmentary perspective view showing an upper portion of the mobile boat support and the height adjustment mechanism for the support structure carried by the mobile boat support.

Turning now to the extendable support 18 mounted on the carriage 16, the extendable support includes a telescoping center support 30. Center support 30 is pivotally connected to the back member 22 of the carriage frame. It is a telescoping structure that includes an upper member telescopically adjustable in a lower member. As seen in FIG. 8, center support 30 includes a lower tube 30B and an upper tube 30A that is telescopically held by the lower tube. That is, upper tube 30A can slide up and down in the lower tube 30B. In addition, the center support includes an upper threaded member 30C that is moveable with respect to the upper member of tube 30A. As will be described later, the upper member 30C provides for fine height adjustment of a support pad 36 that is secured to the upper portion of the upper threaded member 30C. Hence, the center support can be extended and retracted and particularly adjusted to engage a boat hull when the boat cradle system 10 of the present invention is utilized to cradle a boat.

Figure 6:
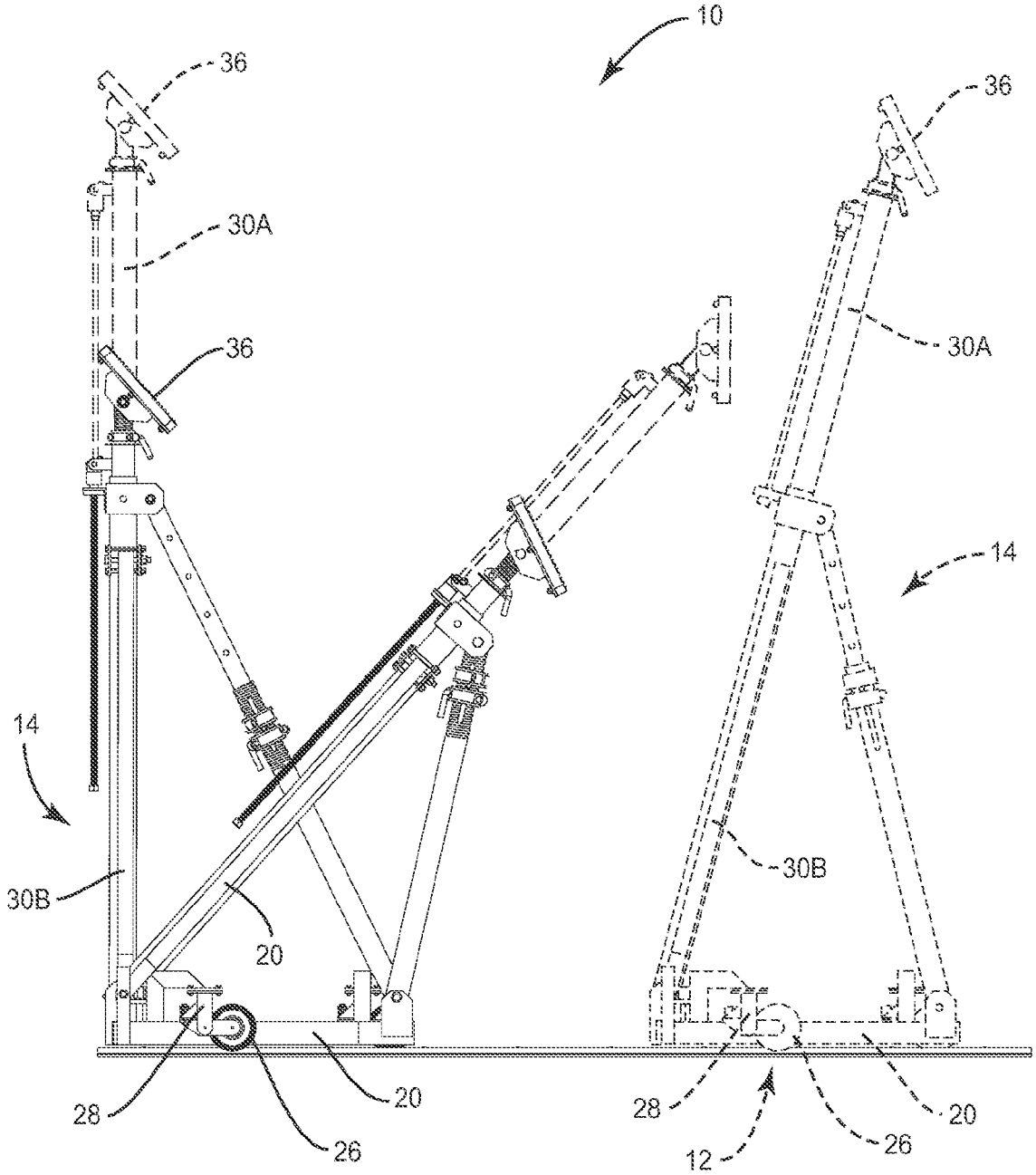
FIG. 6 is a side elevational view of a portion of the boat cradle system showing at least one mobile boat support in the outer inoperative position on the deck and showing in dotted lines the mobile boat support in an inner operative position where it can engage and support a portion of a boat.

Structure mounted on the carriage 16 is provided to support the center support 30. In this regard, there is provided a pair of side angle supports 32 that extend upwardly from the carriage 16 and are connected to the center support 30 for at least partially supporting the center support. In the case of the embodiment shown herein, the angle supports 32 are pivotally connected to outer rear portions of the carriage 16 and extend upwardly and inwardly to where their outer end portions connect to a connecting structure 31 that, in turn, is connected to the center support 30. See FIG. 8. It is appreciated that because of the pivotable connections at both ends of the side angle supports 32, that the side angle supports can pivot or swing back and forth as the center support 30 is pivoted and moved from a vertical upright position to an inclined position (FIG. 6).

In addition, center support 30 is further supported by an adjustable forward support 34. Forward support 34 is pivotally connected to the front center portion of the carriage 16 and projects upwardly therefrom to where an upper portion thereof is pivotally connected to a connector 33 that is, in turn, connected to an intermediate portion of the center support 30. As seen in the drawings, the forward support 34 is a telescoping structure that is adjustable from an extended position, shown in FIG. 7, to a retracted position. When the center support 30 assumes a vertical upright position, the forward support 34 is generally extended. When the center support 30 is pivoted inwardly to the position shown in FIG. 6, the forward support 34 is retracted.

There is provided a height adjustment mechanism for extending and retracting the center support 30. More particularly, the height adjustment mechanism is designed to extend the upper section 30A of the center support from a retracted position shown in FIG. 2 to an extended position shown in FIG. 7. The height adjustment mechanism is particularly shown in FIG. 8 and comprises an elongated threaded rod 48 that is threaded in a threaded opening provided in bracket 62 which is secured to connector 33 which is, in turn, fixed to the lower member 30B of the center support 30. Threaded rod 48 includes an upper portion 48A that is pivotally connected to a clevis or bracket 64 that is secured to one side of the upper telescoping member 30A. It follows that by rotating the threaded rod 48 in a selected direction, the threaded rod will move upwardly through the threaded opening in bracket 62. This will lift the upper section 30A of the center support and move the upper section 30A relative to the lower section or lower member 30B. The lower end of the threaded rod 48 is adapted to connect to an electric drill or other powered device for turning and driving the threaded rod. That is, for example, the threaded shaft 48 can be rotatively driven by an electric drill which can be used to raise and lower the upper section 30A. This is especially beneficial given that the support pad 36 is very heavy and difficult for one person to lift.

The height adjustment mechanism just described is useful in positioning the support pad close to the hull of the boat. However, the center support 30 is provided with a fine adjustment mechanism for finely adjusting the height of the support pad 36 to where it actually engages the boat hull. The fine adjustment mechanism is provided by the threads on the upper member 30C and the threaded locking collar 66. See FIG. 8. This enables the upper threaded portion 30C to be raised and lowered relative to the upper section 30A. The locking collar 66 can be positioned with respect to the threaded upper section 30C and the upper member 30A so as to securely station the support pad 36 in place. Finally, both the lower section 30B and the upper section 30A of the center support include through openings for receiving a locking or stationing pin. These openings can be appropriately aligned and a pin inserted through aligned openings of the lower member 30B and of the upper member 30A so as to secure the center support 30. It should be pointed out that the fine height adjustment described above is used once the locking pin has fixed the height of the upper member 30A with respect to the lower member 30B.

Figure 3:
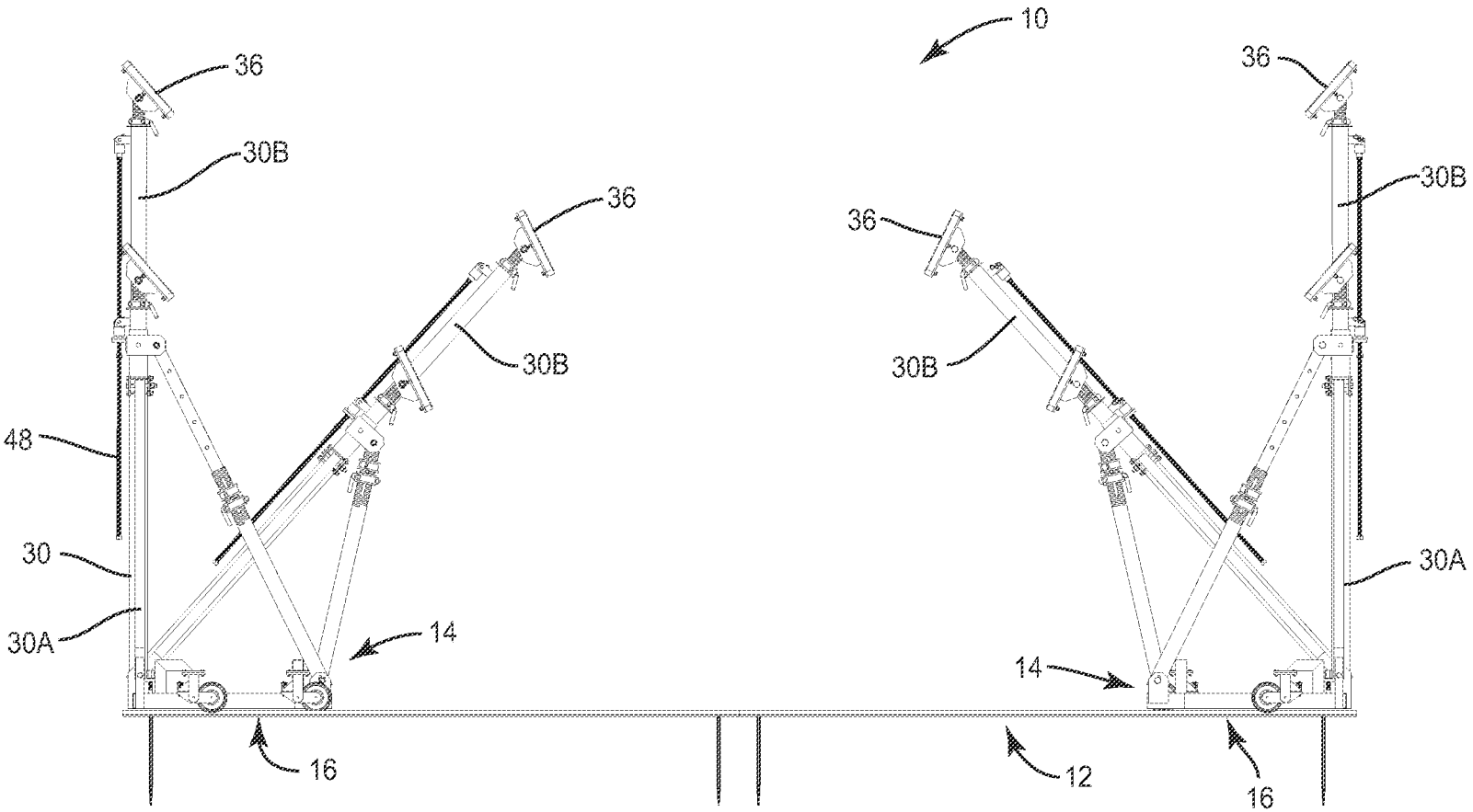
FIG. 3 is an end elevational view of the boat cradle system of the present invention showing some mobile boat supports in a vertical position and some in an inclined position.

The same height adjustment mechanism can be employed when de-cradling a boat. That is, the actuating rod 48 can be turned in the opposite direction by an electric drill or other powered device so as to slowly lower the support pad 36 and disengage the same from the boat hull. It is appreciated that when cradling a boat or de-cradling a boat that temporary supports may be used to support the boat. Also, it is envisioned that the boat cradling system 10 of the present invention can be utilized without employing temporary supports. For example, the boat cradling system 10 can be used to temporarily hold a boat in an elevated position so that a boat trailer can exit the bay slowly. FIG. 3 shows how this approach works. A number of the mobile boat supports 14 can be used to temporarily support a boat. In this case, the forward center support 34 is completely retracted and the center support 30 is extended to a maximum. This approach can be used to slightly lift the boat and allow the trailer to withdraw from the bay. Thus, it is seen that the boat cradling system 10 itself can be used in a manner to provide temporary support for a boat.

Figure 4:
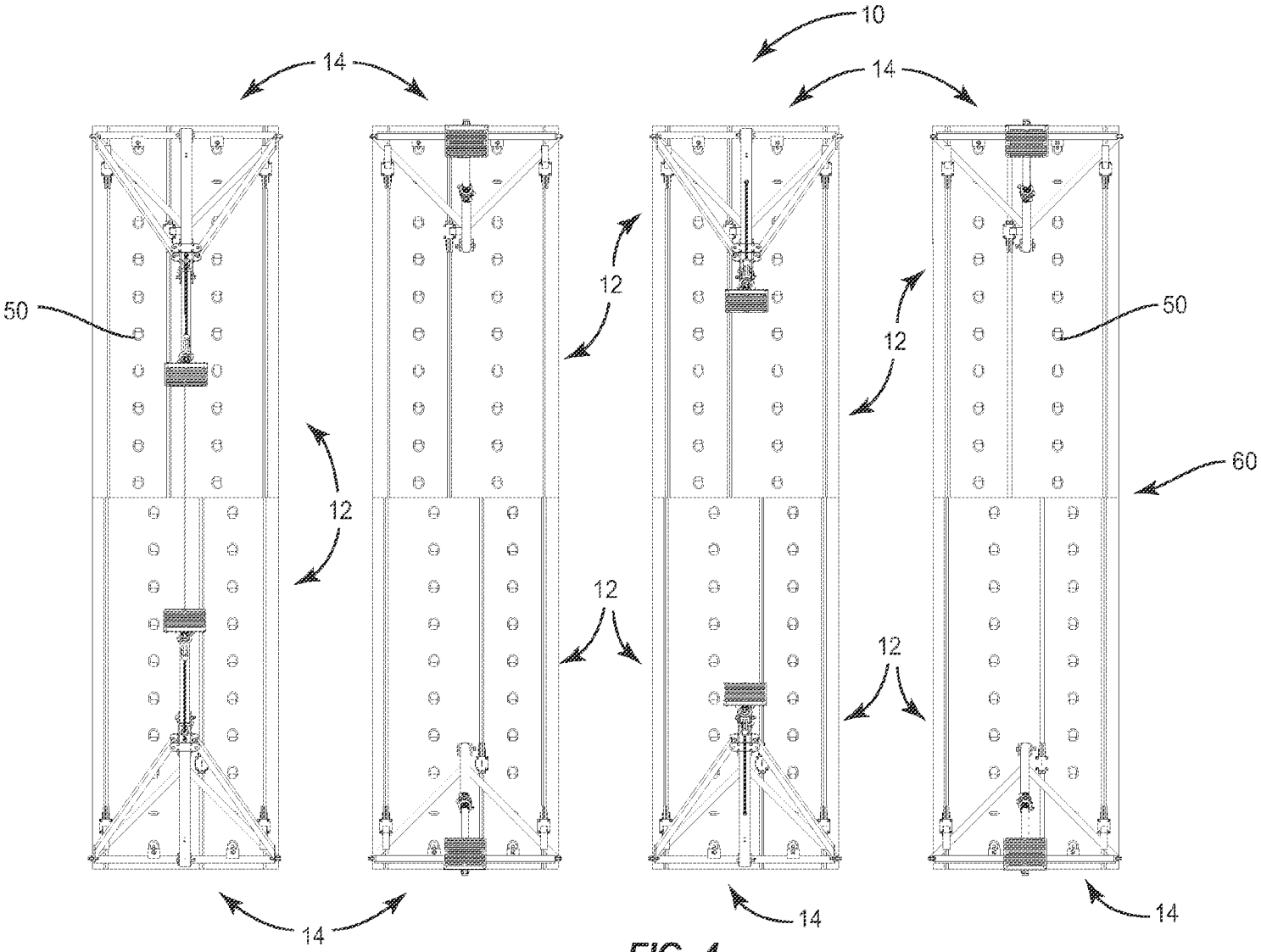
FIG. 4 is a top plan view of the boat cradle system.

Once the mobile boat supports 14 are positioned in the operative position the mobile boat supports 14 should be securely stationed or anchored to the deck 12. To achieve this function, each deck 12 is provided with a series of spaced apart tiedowns 50. As seen in FIGS. 1 and 4, each deck 12 includes two parallel rows of tiedowns 50 that extend substantially the entire length of the deck. In the embodiment illustrated herein, each tiedown 50 comprises a loop anchored to the deck 12. Carriage 16 of each mobile boat support 14 includes at least two connectors 52 for connecting to the tiedowns 50. In the case of the embodiment illustrated herein, on opposite sides of the carriage 16 there is provided two connectors 52 that are aligned with the two parallel rows of tiedowns 50. Connectors 52 secured on the carriage 16 comprise a J-hook connector. The J-hooks depend downwardly from the carriage 16 and hook into the tiedowns 50. See FIG. 7. Once hooked into the tiedowns 50, the J-hooks are adjusted by pulling them upwardly to form a relatively tight connection between the carriage 16 and the deck 12. This will anchor the mobile boat support 14 in an operative position.

FIG. 4 shows a plan view of one exemplary configuration for the boat cradle system 10 of the present invention. As seen therein, there are eight decks 12 provided with the decks on the upper side being aligned with the decks on the lower side. In FIG. 4, the mobile boat supports 14 are shown in their outer inoperative position. Note that there is a boat receiving area 60 that is generally defined between the mobile boat supports 14 as positioned in FIG. 4.

In order to cradle up a boat, the boat is positioned over the decks 12 such that the boat lies generally centrally thereover and inwardly of the eight mobile boat supports 14. Once positioned in the boat receiving area 60, the boat is temporarily supported by any number of conventional temporary supports. Once properly positioned in the boat receiving area 60 and temporarily supported, the respective mobile boat supports 14 are pushed inwardly. This can be accomplished by a single person. Once the mobile boat supports 14 have been properly positioned inwardly and in the operative position for supporting the boat, each mobile boat support 14 is anchored in the operative position by connecting the connectors or J-hooks 52 associated with each carriage 16 with two underlying tiedowns 50. The J-hooks are tensioned rather tightly so as to anchor each mobile boat support 14 in position. Thereafter, the center support 30 of the extendible support 18, carried on each mobile boat support 14, is appropriately angled and extended to where the support pad 36 is positioned relatively close to the boat hull. The height adjustment of the center support 30 is performed by extending the upper telescoping section 30A of the center support relative to the lower base member 30B and then securing a holding pin in appropriate aligned openings that extends through both members of the center support 30. Once this course adjustment is made, the support pad 36 on each mobile boat support lies relatively close to the boat hull. Thereafter, the fine adjustment mechanism described above can be utilized to raise the support pad 36 into engagement with the boat hull. That is, the locking collar 66 can be actuated to disengage the threads of the upper member 30C and the upper member 30C can be raised to where the support pad 36 engages the boat hull. Thereafter, the locking collar 66 can engage the threads of the upper member 30C and because the locking collar 66 is supported on the upper portion of the upper member 30A, it follows that the support pad 36 is securely supported. See FIG. 8. Once all of the support pads 36 properly engage the boat hull, then the temporary supports of the boat can be relieved and the boat is securely stationed over the decks 12.

Figure 9:
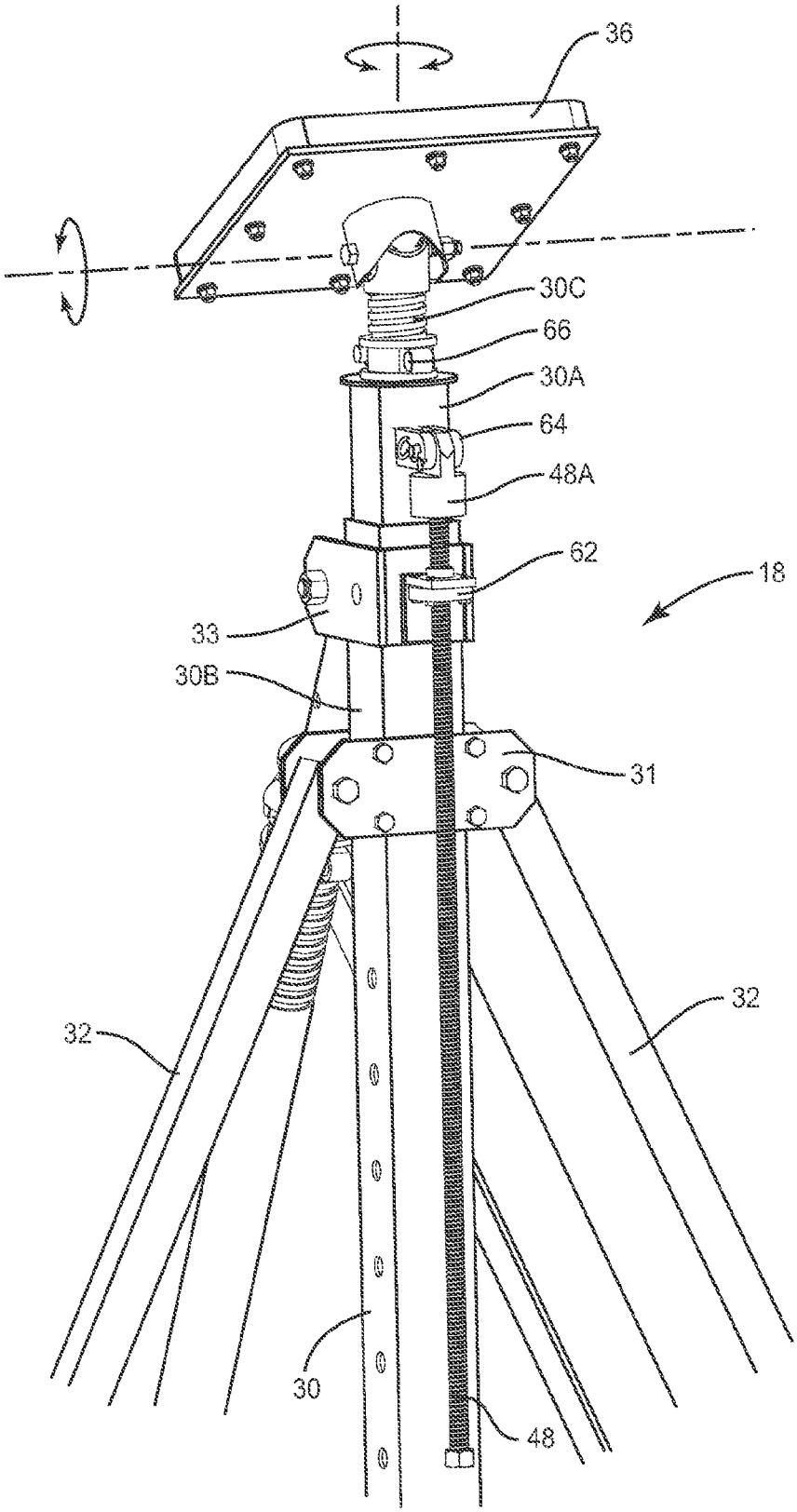
FIG. 9 is an alternative view showing the upper portion of the mobile boat support and the height adjustment mechanism for the support structure.

FIG. 9 shows another design for the boat support structure carried by the mobile boat support. The design shown in FIG. 9 is identical to that shown in FIG. 8 except that there is provided a more robust and stronger structural connection between the support pad 36 and its back plate and the upper member 30C. This is a preferred design, especially when there is a need for substantial strength in the structure that connects the upper member 30C to the upper support pad 36.

In the example just described, eight decks are shown. However, it is appreciated that as few as four decks might be used and for larger boats eight or more decks could be employed.

To de-cradle the boat from the boat cradle system 10 just described, the reverse method is employed. The boat is again temporarily supported and, thereafter, the support pads 36 are driven downwardly to disengaged positions. Thereafter, a single person, after disconnecting the connectors or J-hooks 52 from the tiedowns 50, can easily push each of the mobile boat supports 14 back to their outer inoperative position. Now the boat can easily be removed from the boat receiving area 60.

There are many advantages to the boat cradle system 10 of the present invention. The quick adjust J-hooks 52 enable the setup to be tightened or loosened quickly with an impact wrench after which the spring loaded carriage 16 can be rolled effortlessly out of the way by a single person. This means that the entire cradle bay can now be widened so the boat can be positioned in the bay by one person in minutes instead of hours and a great deal of laborious work. In addition, the design of the metal decks 12 enable large boat carrying machines with large tires to pass over the decks 12 without having to use steel ramps or other means to clear higher profile structures. The design of the carriage enables it to move back and forth along the deck 12 with tracking precision instead of being dragged in the dirt. Another advantage is the feature of the automatic height adjustment mechanism for the support pads 36. The power adjuster for the support pads 36 allows an impact gun or a battery-powered drill to raise the very heavy pad assemblies 36 to engage the boat hull effortlessly. A component of the boat cradle system 10 is a combination of stainless steel and brass nuts to avoid long-term corrosion that will "lock" components together when the boat is left undisturbed for long terms. The center support 30 is constructed of square tubing instead of round so that the pad assembly 36 stays fixed in an upright position and does not spin in the bore of the main support structure. This is especially noteworthy with respect to the eight adjustment mechanism provided for the support pads 36.

Another advantage of the boat cradle system 10 of the present invention is that it can be provisioned and placed in locations away from the sea or other bodies of water. That is, the boat cradle system 10 of the present invention can be located at locations higher than sea level where wind damage and tidal surges can be avoided. This is substantially more economical than attempting to cradle and support boats in marinas and in protected coves in and around seas.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A boat cradle system for supporting a boat, comprising:

a plurality of main supports;

at least one moveable boat support moveable back and forth on each main support, each mobile boat support including:

(i) a carriage having one or more wheels;

(ii) an extendable support carried by the carriage and moveable between a retracted position and an extended position;

(iii) a support pad disposed on an end portion of the extendable support for engaging the boat;

each main support including a track and wherein the carriage of each moveable boat support engages the track and is moveable back and forth on the track; and wherein the main supports are positionable in a boat receiving area and a plurality of the moveable boat supports are moveable back and forth on the main supports between an outer inoperative position and an inner operative position.

2. The boat cradle system of claim 1 wherein each main support is elongated and the track includes a series of laterally spaced rails that receive and support a plurality of wheels on the carriage.

3. The boat cradle system of claim 2 wherein the rails assume a generally inverted "V" shape and project above an upper surface of the main supports and wherein the wheels of the carriage include a generally V-shaped groove that engage the rails.

4. The boat cradle system in claim 1 wherein each main support is elongated and includes at least three spaced apart rails for guiding the mobile boat support back and forth on the main support.

5. The boat cradle system of claim 1:

wherein each main support is anchored to the ground or to an underlying structure;

wherein the boat cradle system includes at least four main supports with one mobile boat support moveably supported on each main support; and wherein the main supports are arranged such that the boat receiving area is defined between at least two pairs of the mobile boat supports.

6. The boat cradle system of claim 1 including means for securing the moveable boat supports at various locations on the main supports.

7. The boat cradle system of claim 1 wherein the main supports include a plurality of tiedowns and wherein the carriage of each moveable boat support includes a connector for connecting to the tiedowns and securely stationing the mobile boat supports.

8. The boat cradle system of claim 7 wherein the tiedowns are longitudinally spaced along a travel path of the mobile boat supports.

9. The boat cradle system of claim 1 wherein the carriage of the mobile boat support comprises a generally triangularly-shaped frame and at least three wheels.

10. The boat cradle system of claim 9 wherein each main support includes at least three rails and wherein the three wheels of each carriage engages and moves on the rails.

11. A boat cradle system for receiving and supporting a boat in a boat receiving area, comprising:

a track structure disposed in the boat receiving area where the track structure includes multiple tracks;

a series of moveable boat supports mounted on the track structure and moveable back and forth on the track structure;

each moveable boat support including a carriage having wheels;

each moveable boat support including an extendable support carried by the carriage and moveable between a retracted position and an extended position;

a support pad disposed on an end portion of the extendable support for engaging the boat;

the carriage of each moveable boat support being supported on the track structure and moveable back and forth between an inoperative position and an operative position;

wherein in the inoperative position, the moveable boat support and the carriage thereon is disposed in an outer position and wherein in the operative position the mobile boat support and carriage thereof is disposed in an inner position on the track structure and positioned to engage and support the boat.

12. The boat cradling system of claim 11 wherein the track structure includes multiple sets of tracks and wherein each set of tracks includes at least three rails for engaging and supporting the wheels of the carriage.

13. The boat cradling system of claim 11 wherein the same is provided with a structure for securing the mobile boat support in the operative position with respect to the rail structure, whereby the mobile boat supports are prevented from moving substantially on the track structure when supporting the boat.

14. The boat cradling system of claim 11 wherein the track structure is disposed on or over a deck.

* * * * *